US005363776A

United States Patent [19]

Wark

[11] Patent Number: 5,363,776

[45] Date of Patent: Nov. 15, 1994

[54] EXHAUSTER INLET VENTURI

[75] Inventor: Rickey E. Wark, Lake Angeles, Mich.

[73] Assignee: Sure Alloy Steel Corporation, Warren, Mich.

[21] Appl. No.: 111,196

[22] Filed: Aug. 24, 1993

[51] Int. Cl.[5] ..... F23K 1/00

[52] U.S. Cl. ..... 110/106; 110/232; 241/48; 241/56

[58] Field of Search ..... 110/104 R, 106, 232; 209/144; 241/56, 48

[56] References Cited

U.S. PATENT DOCUMENTS

| | | | |
|---|---|---|---|
| 3,767,045 | 10/1973 | Voelskow | 209/144 |
| 3,770,124 | 11/1973 | Frangquist | 209/144 X |
| 4,454,825 | 6/1984 | Musto | 110/106 |
| 4,478,157 | 10/1984 | Musto | 110/106 |
| 4,637,556 | 1/1987 | Dunn | 241/48 |

*Primary Examiner*—Edward G. Favors
*Attorney, Agent, or Firm*—Krass & Young

[57] ABSTRACT

An inlet venturi for coal-side exhauster fan structure used to deliver pulverized coal to a combustion chamber. Generally, the inlet venturi has an axial length comparable to that of the exhauster fan inlet, resulting in a shallow, smooth transition angle from the venturi to whizzer ring or similar structure for guiding the coal flow into the center of the fan assembly. The inlet venturi includes a back plate or collar portion which prevents eddy effects and pressure drop between the venturi throat and the exhauster fan inlet, and further serves to accurately position the venturi in the exhauster fan inlet. The inventive inlet venturi structure additionally permits the removal of some or all of the "whizzer" structure commonly used on such fans, resulting in substantial savings in power needed to drive the fan.

13 Claims, 3 Drawing Sheets

EXHAUSTER INLET VENTURI

FIELD OF THE INVENTION

The present invention is related to exhauster fans used to radially distribute an axial flow of pulverized coal to a combustion chamber, and more particularly to exhauster fan inlet structure.

BACKGROUND OF THE INVENTION

Coal-fired combustion chambers, for example those used in utility plants to generate electricity, require the efficient delivery of pulverized coal. Bowl mills of a known type are used to pulverize the coal. In prior art systems, it is known to use a coal-pulling fan, known as an exhauster fan, between the bowl mill pulverizer and the combustion chamber, creating an air flow which draws the pulverized coal from the mill into the fan through a generally circular inlet, the exhauster fan radially directing the coal into a conduit extending to one or more nozzles disposed in the vicinity of the combustion chamber. The fans can employ a conical diverter cap on their hub, which serves to radially divert the coal into the rotating fan blades.

These coal-side exhauster fans are sometimes referred to as "dirty side" fans, because they are positioned in the middle of the coal flow between the mill and combustion chamber.

Coal-side exhauster fans are also known to employ what are known as "whizzer" blades mounted on the leading edges of the primary fan blades. The whizzer blades emanate radially from a whizzer disk and ring arrangement mounted coaxially with the fan and the inlet. The purpose of the whizzer blade and supporting structure is ostensibly to prevent heavier particles of coal from settling out or being trapped between the fan and the fan housing, where it causes wear on the housing.

A serious disadvantage with such whizzer blade structure is that it adds significantly to the weight of the fan, and consequently to the power required to drive the fan. In a continuously-running large utility application, such power costs can be considerable. Moreover, it is this inventor's belief that the whizzer blades are largely ineffective in achieving their stated purpose of preventing the settling out of heavier coal particles between the fan blades and the housing.

One attempt to improve coal flow through such an exhauster fan as described above has been to provide a shallow, sharply-angled, venturi-shaped cone in the exhauster fan inlet to direct the incoming coal-air mixture toward the center of the exhauster fan rather than into the whizzer blades. This experiment was deemed a failure, however, because the steep angle of the cone impeded, rather than helped, flow through the inlet. Moreover, the short length of the cone (substantially less than the axial length of the exhauster fan inlet), its correspondingly sharp transition angle (necessary to direct coal into the whizzer ring extending into the inlet), and a significant axial gap between the cone outlet and the whizzer ring inlet caused significant eddy effects, carrying coal flow backward into the gap between the cone and the exhauster inlet and creating a substantial pressure drop which actually impeded flow.

SUMMARY OF THE INVENTION

In view of the drawbacks and ineffectiveness of known whizzer blade structure, and the failings of previous known attempts to employ an inlet cone to direct coal flow into tile exhauster fan, I have invented an exhauster inlet venturi device which not only improves coal flow through the inlet to the fan without the drawbacks of previous devices, but works both with and without whizzer ring structure to improve the efficiency of, and reduce wear in, the exhauster fan.

In general, the invention comprises an inlet venturi mounted within the exhauster inlet, the venturi having a shallow entry or transition angle and a length approximating that of the exhauster inlet itself, or greater. The throat or exit of the inlet venturi is positioned immediately adjacent the whizzer ring and/or axial fan inlet, and is of a slightly smaller diameter to ensure a smooth, faired transitional flow of coal from the venturi to the fan.

In a further embodiment of the invention, the venturi includes a collar or back plate extending radially outward from the throat of the venturi to mate with the interior wall of the fuel inlet. The back plate serves to position the venturi within the inlet, and contacts the inner end of the exhauster inlet in sealing fashion to prevent eddying and backflow of coal particles between the venturi and the exhauster inlet. In one version the back plate extends both forward and outward in a reversely-angled conical section overlying the inlet portion of the whizzer ring. In another version, the back plate is essentially perpendicular to the exhauster inlet, extending straight up from the venturi throat.

In an alternate embodiment of the invention the whizzer ring is trimmed back into the fan housing, and the venturi extends approximately the entire length of the exhauster inlet, the back plate lying essentially in the plane of the inner end of the exhauster inlet at the transition point from inlet to fan housing.

In a further and preferred embodiment, the whizzer ring and whizzer blades are removed entirely, and the venturi includes a cylindrical extension of the throat into the fan housing to a point adjacent the hub of the fan. This embodiment significantly reduces the power consumption of the fan by eliminating the weight of the whizzer ring and blades, and provides the smoothest transitional flow from the inlet to the fan.

These and other features of the present invention will become apparent upon a further reading of the specification.

DETAILED DESCRIPTION OF THE DRAWINGS

Figure 1:
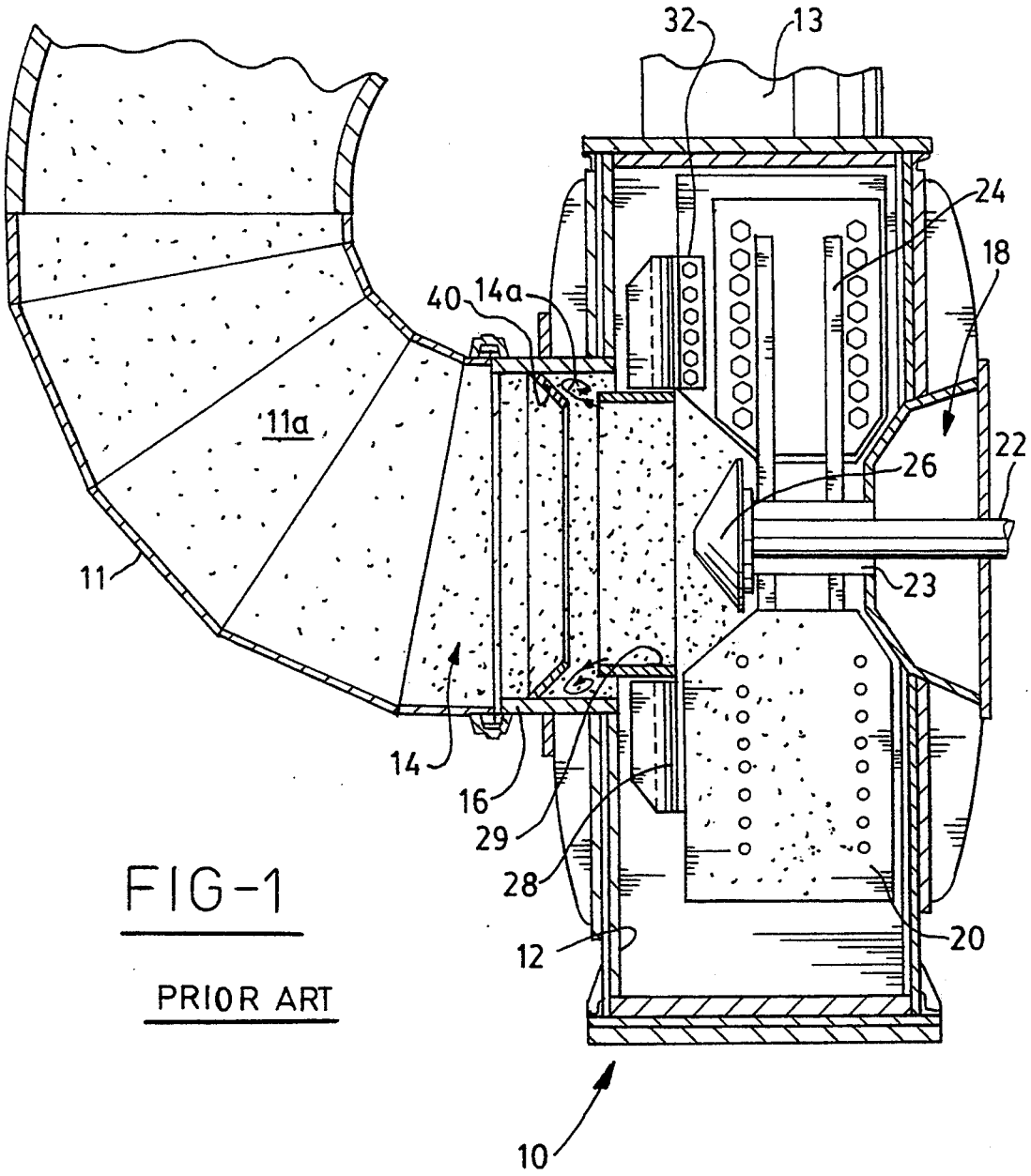
FIG-1 PRIOR ART
FIG. 1 is a schematic representation of a coal-side exhauster fan system of a known type.

Referring now to FIG. 1, a known pulverizer exhauster fan assembly is generally shown at 10, comprising a fan housing 12 and a fuel inlet 14 having a generally circular cross section defined by an exhauster fan cover flange 16 projecting from the Earl housing. Inlet 14 receives a stream of pulverized coal/air 11*a* from a chute 11 connected to a bowl mill pulverizer in a known manner. Fan housing 12 contains a fan 18 having a plurality of radial fan blades 20 connected to a drive shaft 22 by a spider assembly 24. Drive shaft 22 is driven by suitable motor apparatus (not shown), for example synchronously with the bowl mill pulverizer through a gear connection in known manner.

Drive shaft 22 ends in a hub 23, capped with a "cooley cap" radial diverter cap 26 which is essentially concentric with fuel inlet 14. Pulverized coal 11*a* drawn axially through inlet 14 to the interior region of fan 18 is radially diverted by cap 26 to fan blades 20. Fan blades 20 direct the pulverized coal radially to a combustion feed conduit 13 at the top of the housing 12.

Fan 18 is additionally provided with a whizzer disk 28 comprising an annular whizzer ring 29 extending toward and partway into inlet 14, and a plurality of radially dispersed whizzer diffuser angles or blades 30. The whizzer disk 28, ring 29 and blades 30 are connected to rotate with fan 18 by way of whizzer angle mounts 32 bolted onto fan blades 20 in a known manner.

Outlet chute 13 at the top of housing 12 receives tile radially-diverted coal/air flow from the fan and carries it to a combustion chamber in known manner.

The above-described structure is generally known in the art, and will be readily recognized and understood by those skilled in the art.

Still referring to FIG. 1, exhauster fan assembly 10 is provided with an inlet cone 40 positioned in fuel inlet 14 essentially concentric therewith. The inlet cone is cast or otherwise formed from a suitably wear-resistant steel. Inlet cones of the type shown at 40 are intended to improve coal flow into and through fan 18 by directing it into the whizzer ring rather than the whizzer disk and blades, but have been found to be unworkable. Its short axial length and correspondingly steep angle, its position in only a central portion of inlet 14 spaced significantly from the outer end of inlet 14 and the whizzer ring 29, and a significant difference between the cone throat diameter and the whizzer ring combine to impede, rather than enhance, flow. In particular, eddy currents arise between the cone 40 and inlet 14 at region 14*a*, resulting in a very substantial pressure drop. These eddies of coal/air 11*a* also cause wear on the inlet and further result in coal particles diverted outside the whizzer ring 29 to be trapped between the fan and housing.

Figure 2:
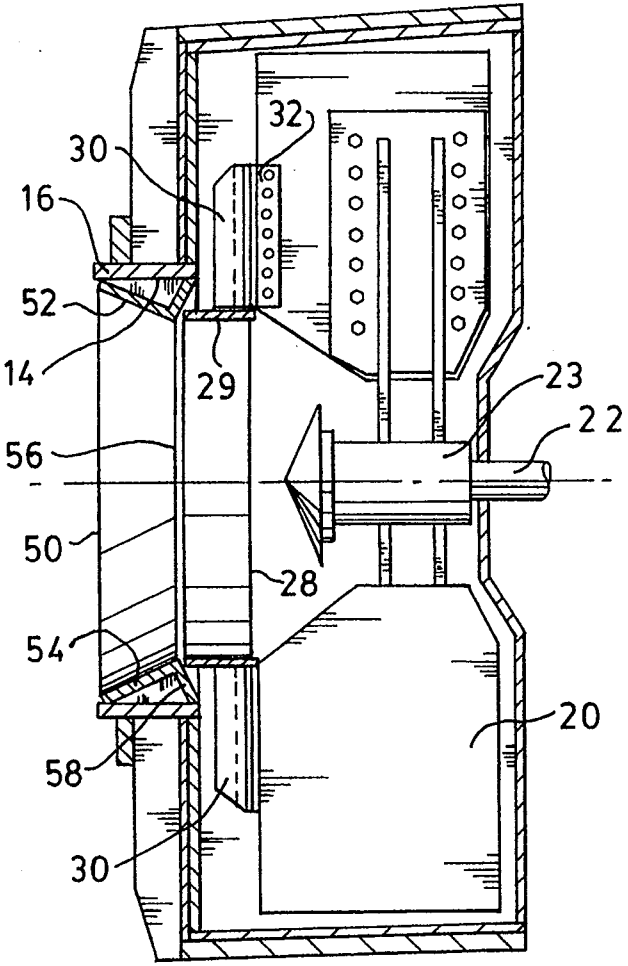
FIG. 2 is a side section view of a first embodiment of an inlet venturi according to the present invention in the exhauster fan inlet.

Referring to FIG. 2, a first embodiment of an inlet venturi according to the present invention is shown at 50, mounted in fuel inlet 14. The inlet venturi of the present invention is primarily intended as a retrofit device, and can be welded or fastened in other suitable manner in position in the inlet 14. However, it should be understood that the inlet venturi of the present invention could be manufactured integrally with the inlet and housing, and is not necessarily limited to coal-side exhauster fan applications.

inlet venturi 50 in the embodiment of FIG. 2 includes a gently tapered conical body portion 52 defined by wall 54 extending from the outer end of fuel inlet 14 toward the interior of the fan housing 12. Body portion 52 ends in a throat 56 of minimum diameter and area located immediately adjacent the whizzer ring 29 near the inner end of fuel inlet 14. An annular back plate 58, in FIG. 2 integral with wall 54, extends outwardly and angled slightly forward from throat 56 to the inner end of fuel inlet 14. The effect is that back plate 58 is a reversely-conical cross-section extending over and around the inlet end of whizzer ring 29 . As mentioned above, inlet venturi 50 is preferably welded in position after a careful 5 retrofit. Frequently, the fuel inlet 14 is found to be non-concentric, and inlet venturi 50 may need to be custom fit to a particular inlet 14.

Figure 3:
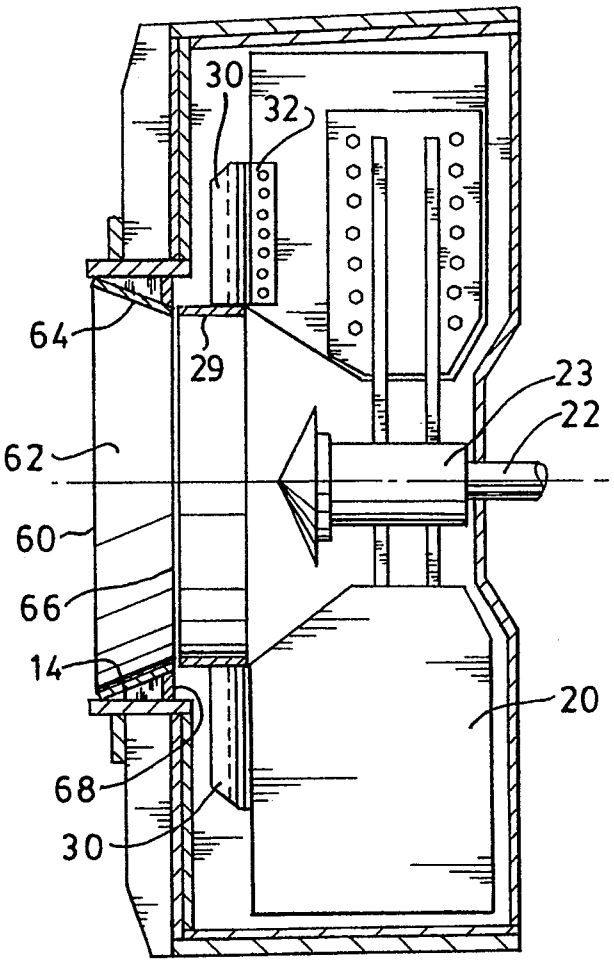
FIG. 3 is a side section view of a second embodiment of an inlet venturi according to the present invention in the exhauster fan inlet.

Referring to FIG. 3, a second embodiment of inlet venturi according to the present invention is shown at 60 mounted in fuel inlet 14. Inlet venturi 60 includes a gently tapered body section 62 extending approximately three quarters of the distance from the outer end of the fuel inlet 14 to its inner end at a point immediately adjacent the whizzer ring 29. Body 62 is defined by a wall 64, and is essentially identical to body 52 of inlet venturi 50 in FIG. 1. It includes a throat of minimum diameter and area 66, again substantially identical to the structure 50,52,54,56 in the embodiment of FIG. 1. However, the inlet venturi 60 of FIG. 3 includes an annular back plate 68 which is perpendicular to the whizzer ring and the direction of coal flow through inlet 14, extending straight up from throat 66 to a point on the interior wall of inlet 14 aligned with throat 66.

Back plate 68 and body 62 of inlet venturi 60 in FIG. 3 are preferably manufactured separately, and subsequently assembled when fitting the venturi 60 to a particular inlet 14. This two-piece embodiment is preferable over the integrally-molded, one-piece venturi 50 of FIG. 2, due to ease of manufacture and the ability to properly position venturi 60 within inlet 14 by tailoring the dimensions of back plate 68 for a concentric fit.

Another advantage of the perpendicular back plate 68 in the embodiment of FIG. 3 is that it can be made from a less expensive, easier to machine mild steel than body 62 of venturi 60. Venturi 60 smoothly funnels the coal flow into ring 29 with no eddy effects or uncontrolled coal to abrade plate 68.

It should be noted that in the embodiments of FIGS. 2 and 3, inlet venturis 50 and 60 do not require the alteration or removal of any portion of whizzer disk 28, ring 29 or blades 30. They extend to a point immediately adjacent the inlet of the whizzer ring 29, in the illustrated embodiment approximately (and preferably) on the order of 0.25 inches, but do not interfere with the position, structure or function of the whizzer structure. However, because coal flow is efficiently directed into the center 19 of fan 18 through whizzer ring 29, with little or no loss of coal into the region occupied by the whizzer blades between fan 18 and housing 12, the inlet venturi structure 50,60 of the present invention makes whizzer blades 30 superfluous, and they can be removed without any adverse effect on the system. This alone creates a substantial reduction in the weight and wind resistance of fan 18, resulting in corresponding savings in power usage.

Figure 4:
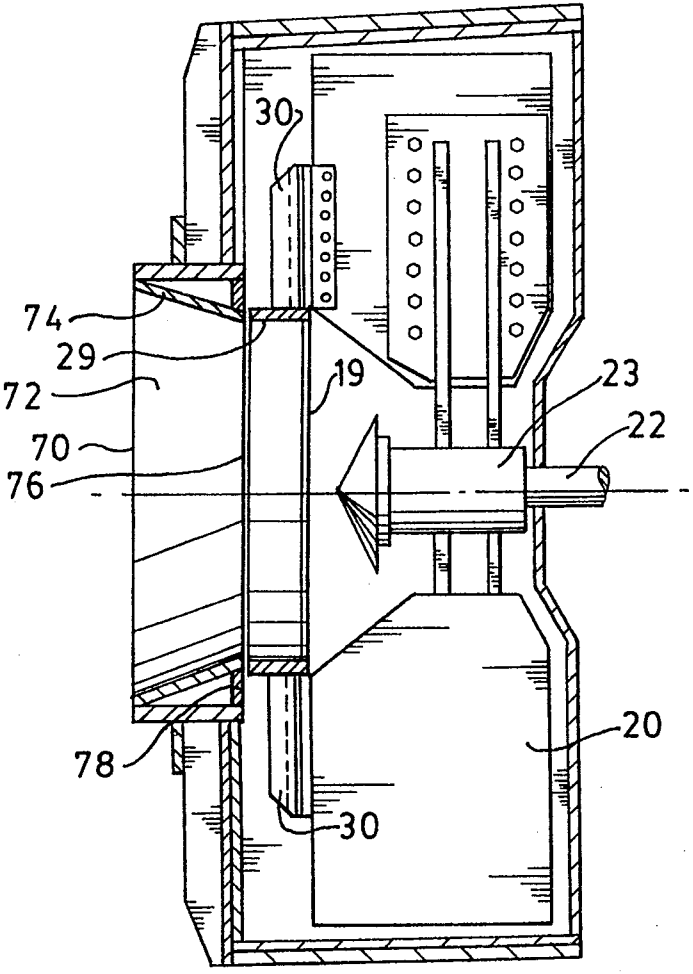
FIG. 4 is a side section view of a third embodiment of an inlet venturi according to the present invention in the exhauster fan inlet.

Referring now to FIG. 4, yet a further embodiment of the inlet venturi of the present invention is shown at 70. Inlet venturi 70 is similar to the embodiment of FIG. 3, having an angled body portion 72 defined by a wall 74, a throat of minimum area and diameter 76, and a perpendicular, annular back plate or collar 78 similar to that shown in FIG. 3. However, body portion 72 of the inlet venturi 70 in FIG. 4 is lengthened and extends the entire length of fuel inlet 14, with back plate 78 and throat 76 mounted flush with the inner end of fuel inlet 14 where it enters the fan housing. This necessitates the removal of the portion of whizzer ring 29 which extends into fuel inlet 14, reducing the weight of fan 18.

The angle of inlet venturi 70 is shallower than the embodiment shown in FIG. 3, creating a smoother transition angle with virtually no pressure drop or flow loss at the junction with whizzer ring 29. Additionally, pressure drop and flow impedance caused by eddy effects between inlet 14 and venturi 70 are eliminated by plate 78.

Again, although inlet venturi 70 can be used in conjunction with whizzer blades 30, it makes blades 30 superfluous and they can be removed.

Figure 5:
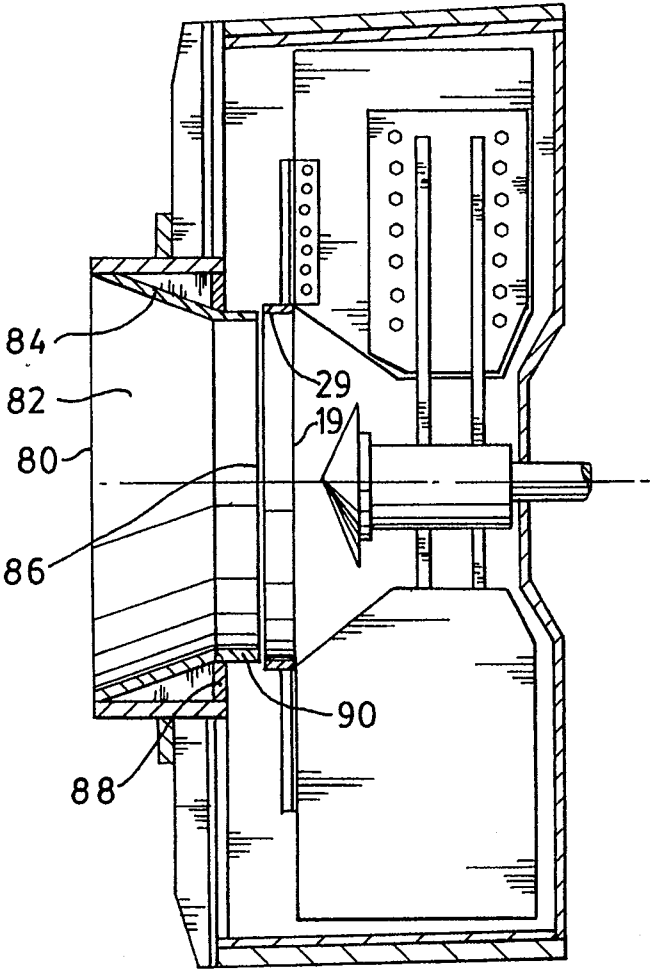
FIG. 5 is a side section view of a fourth embodiment of an inlet venturi according to the present invention in the exhauster fan inlet.

Referring now to FIG. 5, a best mode of carrying out the invention is illustrated as inlet venturi 80 having a body 82 defined by a wall 84, a throat of minimum area and diameter 86, and a perpendicular back plate 88 similar to that shown in FIG. 3. The inlet venturi 80 shown in FIG. 5 is similar to that shown in FIG. 4, in that body 82 extends the entire length of fuel inlet 14, with back plate 88 and throat 86 essentially flush with the inner end of the fuel inlet at the junction with the interior of the fan housing. However, inlet venturi 80 additionally includes an integral cylindrical extension 90 extending into the fan housing to a point near fan inlet 19 defined by a modified, lightweight, short throat ring 29*a* welded to whizzer disk 28. Whizzer ring 29 and whizzer blades 30 have been eliminated, substantially reducing the weight of fan 18.

Cylindrical extension 90 is parallel to, and of slightly smaller diameter than, disk 28. There is accordingly no transition angle from the junction of extension 90 with disk 28. Of all the embodiments disclosed, the embodiment of FIG. 5 simultaneously achieves the greatest weight reduction, by removing most of the whizzer structure, and provides the smoothest transition angle through the inlet venturi with an essentially arcuate coal flow path into the fan inlet 19.

In all of the inlet venturi embodiments of FIGS. 2–5, the gap between the inlet venturi and the whizzer ring is small, preferably on the order of $\frac{1}{4}$ inch. Also, the alignment and relative diameter of the inlet venturi and the fan inlet ring structure is important. The inlet venturi throat or exit point adjacent the ring structure is slightly smaller in diameter than the ring structure, on the order of $\frac{1}{8}$ to $\frac{1}{2}$ inch, in the manner of a waterfall joint. The inlet venturi and fan inlet ring structure should also be aligned to be as concentric as possible.

All of the above-disclosed embodiments of the invention achieve a smooth transition angle of the coal flow into fan 18, making optional and therefore permitting the removal of some or all of the heavy, energy-consuming whizzer structure. In practice the drive motor current in a typical installation has been reduced by as much as two amps, resulting in substantial power and operating cost savings. The inventive venturi structures further promote smooth flow with minimum pressure drop in the fuel inlet area and are easily retrofit into exhauster fans.

These and other advantages of the present invention will be apparent to those skilled in the art. It should be understood that the foregoing description is not intended to be limiting, as many variations and modifications of the invention can be made and still lie within the scope of the appended claims.

What is claimed is:

1. In a pulverizer exhauster fan having a housing, a fan mounted to rotate in the housing, a circular inlet coaxial with the fan for delivering pulverized coal flow to the fan for subsequent radial diversion to an outlet in the housing, and structure defining an inlet into the center of the fan, the invention comprising:

an inlet venturi mounted in the circular inlet concentric with the fan inlet, the venturi extending from the intake end of the circular inlet to a throat proximate the intake end of the fan inlet, the venturi further including an annular collar portion extending from the throat to the wall of the circular inlet.

2. Apparatus as defined in claim 1, wherein the annular collar is angled forward and overlies the fan inlet.

3. Apparatus as defined in claim 1, wherein the annular collar extends upwardly essentially perpendicular to the flow of pulverized coal through the circular inlet.

4. Apparatus as defined in claim 3, wherein the throat and the annular collar are aligned with the outlet end of the circular inlet.

5. Apparatus as defined in claim 4, wherein the inlet venturi further includes a cylindrical extension extending past the annular collar into the fan housing to a point proximate the fan inlet.

6. In a pulverizer exhauster fan having a housing, a fan mounted to rotate in the housing, a circular inlet coaxial with the fan for delivering pulverized coal flow to the fan for subsequent radial diversion to one or more outlets in the housing, and structure defining an inlet into the center of the fan, the invention comprising:

an inlet venturi mounted in the circular inlet, the venturi decreasing in diameter in the direction of pulverized coal flow through the inlet, the venturi inlet end being positioned at the intake of the circular inlet, the venturi having a throat of minimum diameter immediately adjacent the fan inlet, the throat being concentric with and having a diameter slightly smaller than the diameter of the fan inlet.

7. Apparatus as defined in claim 6, the venturi further including an annular collar portion extending from the throat to the wall of the circular inlet.

8. Apparatus as defined in claim 7, wherein the annular collar is angled forward and overlies the fan inlet.

9. Apparatus as defined in claim 7, wherein the annular collar extends upwardly essentially perpendicular to the flow of pulverized coal through the circular inlet.

10. Apparatus as defined in claim 9, wherein the throat and the annular collar are aligned with the outlet end of the circular inlet.

11. Apparatus as defined in claim 10, wherein the inlet venturi further includes a cylindrical extension extending past the annular collar into the fan housing to a point proximate the fan inlet.

12. Apparatus as defined in claim 5, wherein the throat is smaller than the diameter of the fan inlet.

13. In a pulverizer exhauster fan having a housing, a fan mounted to rotate in the housing, a circular inlet coaxial with the fan for delivering pulverized coal flow to the fan for subsequent radial diversion to one or more outlets in the housing, and structure defining an inlet into the center of the fan, the invention comprising:

inlet venturi means in the circular inlet for directing coal flow from the intake end of the circular inlet to the intake end of the fan inlet, the inlet venturi means having a throat concentric with and immediately adjacent the fan inlet, the venturi means further including means for preventing eddies in the circular inlet between the throat portion and the outlet end of the circular inlet.

* * * * *

UNITED STATES PATENT AND TRADEMARK OFFICE

CERTIFICATE OF CORRECTION

PATENT NO. : 5,363,776

DATED : November 15, 1994

INVENTOR(S) : Rickey E. Wark

It is certified that error appears in the above-identified patent and that said Letters Patent is hereby corrected as shown below:

Column 2, line 2, delete "tile" and insert --the--;

Column 3, line 3, delete "Earl" and insert --fan--;

Column 3, line 26, delete "tile" and insert --the--;

Column 3, line 62, delete "inlet" and insert --Inlet--; and

Column 4, line 7, delete "careful 5 retrofit" and insert --careful retrofit--.

Signed and Sealed this

Thirty-first Day of January, 1995

*Attest:*

*Attesting Officer*

Bruce Lehman

BRUCE LEHMAN

*Commissioner of Patents and Trademarks*